US007303595B1

(12) United States Patent
Janitz

(10) Patent No.: US 7,303,595 B1
(45) Date of Patent: Dec. 4, 2007

(54) IMPACT ABSORBING ISOLATOR SLEEVE AND ASSEMBLY FOR MOUNTING A TROLLING MOTOR

(75) Inventor: Mikel E. Janitz, Collinsville, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/068,193

(22) Filed: Feb. 28, 2005

(51) Int. Cl.
*B63H 21/30* (2006.01)

(52) U.S. Cl. ..... 44/52; 440/6; 440/55; 440/63

(58) Field of Classification Search ..... 440/6, 440/52, 53, 55, 56, 63; 248/640, 642
See application file for complete search history.

(56) References Cited

U.S. PATENT DOCUMENTS 1,958,119 A * 5/1934 Tarr ..... 248/596
2,044,920 A * 6/1936 Smith ..... 248/596
4,129,088 A * 12/1978 Foley, Jr. ..... 440/63
4,555,233 A * 11/1985 Klammer et al. ..... 440/56
6,394,408 B1 5/2002 Henderson et al.

OTHER PUBLICATIONS

Motorguide Twenty-Fifth Anniversary 1987 Catalog.
Motorguide 2002 Product Catalog.
Minn Kota 2005 Catalog.
System 7 *Networking Fishing Systems*.

* cited by examiner

*Primary Examiner*—Sherman Basinger
(74) *Attorney, Agent, or Firm*—Fellers, Snider, Blankenship, Bailey & Tippens, P.C.

(57) ABSTRACT

An assembly for mounting a trolling motor comprising an inventive flexible gripping isolator sleeve positionable around the trolling motor column and a retainer which receives and retains the gripping isolator sleeve in a manner effective for holding the trolling motor column in an operating position. The gripping isolator sleeve is formed and configured in a manner effective for flexing sufficiently to allow the trolling motor to deflect in any direction when impacted and for then automatically returning the trolling motor to its operating position.

13 Claims, 8 Drawing Sheets

IMPACT ABSORBING ISOLATOR SLEEVE AND ASSEMBLY FOR MOUNTING A TROLLING MOTOR

FIELD OF THE INVENTION

The present invention relates to mounting devices and apparatuses for trolling motors which will allow the trolling motor to deflect appropriately in the event of an impact with an underwater obstruction and will preferably also act automatically to return the trolling motor to its operating position when the trolling motor is free of the obstruction.

BACKGROUND OF THE INVENTION

Trolling motors are commonly used on bass boats, pontoon boats, and other watercraft for fishing or for other operations which require a relatively high degree of maneuverability along shorelines or in other tight locations. Various types of trolling motor assemblies are known in the art. One common type of trolling motor is a single tube assembly comprising: an electric motor and propeller assembly secured on the lower end of an elongate tube or other column; a control head or other housing structure attached in fixed position on the upper end of the column; and an electrical cable extending through the column from the control head to the motor and propeller assembly for operating the motor. The single tube trolling motor will typically be either manually rotated or rotated by external mechanical means for steering the watercraft.

An example of another common type of trolling motor is a rotating tube assembly comprising: a control head or other housing structure having a fixed tube extending from the bottom thereof; a rotatable tube or other rotatable column having an upper end which is received in the control head and a lower end which projects from the lower end of the fixed column; an electric motor and propeller assembly secured on the lower end of the rotatable column; an electrical cable extending through the rotatable tube from the control head to the propulsion motor for operating the motor; and a steering motor and gear assembly provided in the control head for rotating the rotatable tube in order to turn the motor and propeller assembly for steering the watercraft.

Various types of mounting systems are known in the art for securing a trolling motor to the deck, transom, or other part of a watercraft. Some of these systems permit the trolling motor to deflect in some manner from its normal operating position in the event that the motor impacts an underwater obstruction. For example, U.S. Pat. No. 6,394,408 discloses a ball and socket-type mounting system which comprises: a hard, rotatable ball element having a central bore through which the column of the trolling motor is received; a gated housing which forms a socket wherein the ball element and the trolling motor column are held and are permitted to rotate; and a position indicator which assists the operator in manually returning the trolling motor to its correct operating position after a deflection occurs. The gated head is secured on the outer end of a pivotable, four bar motor mount. The position indicator consists of a thin, flat (i.e., cylindrical) surface provided around the exterior of the ball element and a corresponding flat surface provided around the interior of the socket. The mounting system of U.S. Pat. No. 6,394,408 allows the trolling motor to deflect in any direction necessary for absorbing direct head-on, reverse, or side impacts or for absorbing glancing blows. The entire disclosure of U.S. Pat. No. 6,394,408 is incorporated herein by reference.

Other types of impact absorbing mounting systems or techniques known or suggested in the art include: bracket assemblies which allow the trolling motor to deflect in only a single plane; using a spring or other shock absorbing member which extends from the motor mount and has a clamp at the outer end thereof which is secured on the trolling motor column; a split ball assembly having a compression spring between the two halves of the ball; and forming the trolling motor column itself from some type of flexible material.

Unfortunately, the impact absorbing mounting systems heretofore known in the art have significant shortcomings. Most are difficult to install. Many cannot be installed on existing trolling motors without disassembling the motor itself. Some do not include any type of automatic return mechanism and therefore require that the operator manually reposition the motor in the event that a deflection occurs. Flexible motor columns are more costly and difficult to produce, particularly to achieve the degree of strength, flexibility and resiliency desired, and cannot be used on all types trolling motors.

Systems which incorporate metal springs or similar devices to provide at least some degree of automatic return are typically more complex and costly and can be particularly difficult to install or replace. Metal spring systems are also disadvantageous because they can rust and corrode and are loud during operation. When functioning, they tend to squeak or rattle. In addition, spring systems typically act in one direction only, usually toward the boat, such that they provide no deflection side to side or forward of the boat. Some spring systems also require operator intervention to tighten or loosen friction knobs to obtain the "right" feel.

SUMMARY OF THE INVENTION

The present invention provides an impact absorbing system for mounting trolling motors which satisfies the needs and alleviates the problems discussed above. The inventive mounting system provides effective energy absorption in the event of generally any type of impact, allows deflection of the trolling motor in any direction, provides automatic and accurate repositioning of the motor following impact, and can be used for mounting any type of trolling motor in generally any location on any type of watercraft. The inventive mounting system is also less complex and more economical than previous mounting systems and can be conveniently and easily installed or replaced on any new or existing trolling motor without having to disassemble the motor in any way.

In one aspect, there is provided an assembly for grasping a column of a trolling motor to mount the trolling motor on a watercraft. The assembly comprises a flexible gripping isolator sleeve positionable on the column and a retainer in which the gripping isolator sleeve is receivable in a manner effective for holding the column in an operating position. The gripping isolator sleeve is formed of at least one rubber material and is configured in a manner effective for flexing sufficiently when an impact occurs between the trolling motor and an underwater obstruction to allow the column to pivot within the retainer away from the operating position. The gripping isolator sleeve is also effective for automatically acting to return the column to the operating position when the trolling motor is free of the underwater obstruction.

In another aspect, there is provided an assembly for gasping a column of a trolling motor to mount the trolling motor on a watercraft comprising a flexible gripping isolator sleeve positionable on the trolling motor column, the gripping isolator sleeve having an exterior, and a retainer in which the gripping isolator sleeve is receivable in a manner effective for holding the column in an operating position. The gripping isolator sleeve has at least one outer void in its exterior which projects into and extends substantially around the gripping isolator sleeve in a manner effective to allow the gripping isolator sleeve to flex sufficiently when an impact occurs between the trolling motor and an underwater obstruction such that the column will pivot within the retainer away from the operating position. The gripping isolator sleeve comprises at least one non-metallic material effective for automatically acting to return the column to the operating position when the trolling motor is free of the underwater obstruction.

In another aspect, there is provided a split isolator sleeve for gripping a column of a trolling motor. The split isolator sleeve comprises: a first longitudinal end; a second longitudinal end; a plurality of splits in the isolator sleeve extending from the first longitudinal end to the second longitudinal end such that the splits divide the split isolator sleeve into a plurality of separable sections, the sections being placeable together around the column such that the split isolator sleeve will be positioned on the column in an original shape; an exterior; and at least one outer void in the exterior which projects into and extends substantially around the split isolator sleeve in a manner effective to allow the split isolator sleeve to flex from the original shape sufficiently when an impact occurs between the trolling motor and an underwater obstruction to absorb the impact. The split isolator sleeve is formed of at least one non-metallic material effective for automatically returning the split isolator sleeve to the original shape when the trolling motor is free of the underwater obstruction.

Further aspects, features, and advantages of the present invention will be apparent to those in the art upon examining the accompanying drawings and upon reading the following Detailed Description of the Preferred Embodiments.

DETAILED DESCRIPTION OF THE PREFERRED EMBODIMENTS

Figure 1:
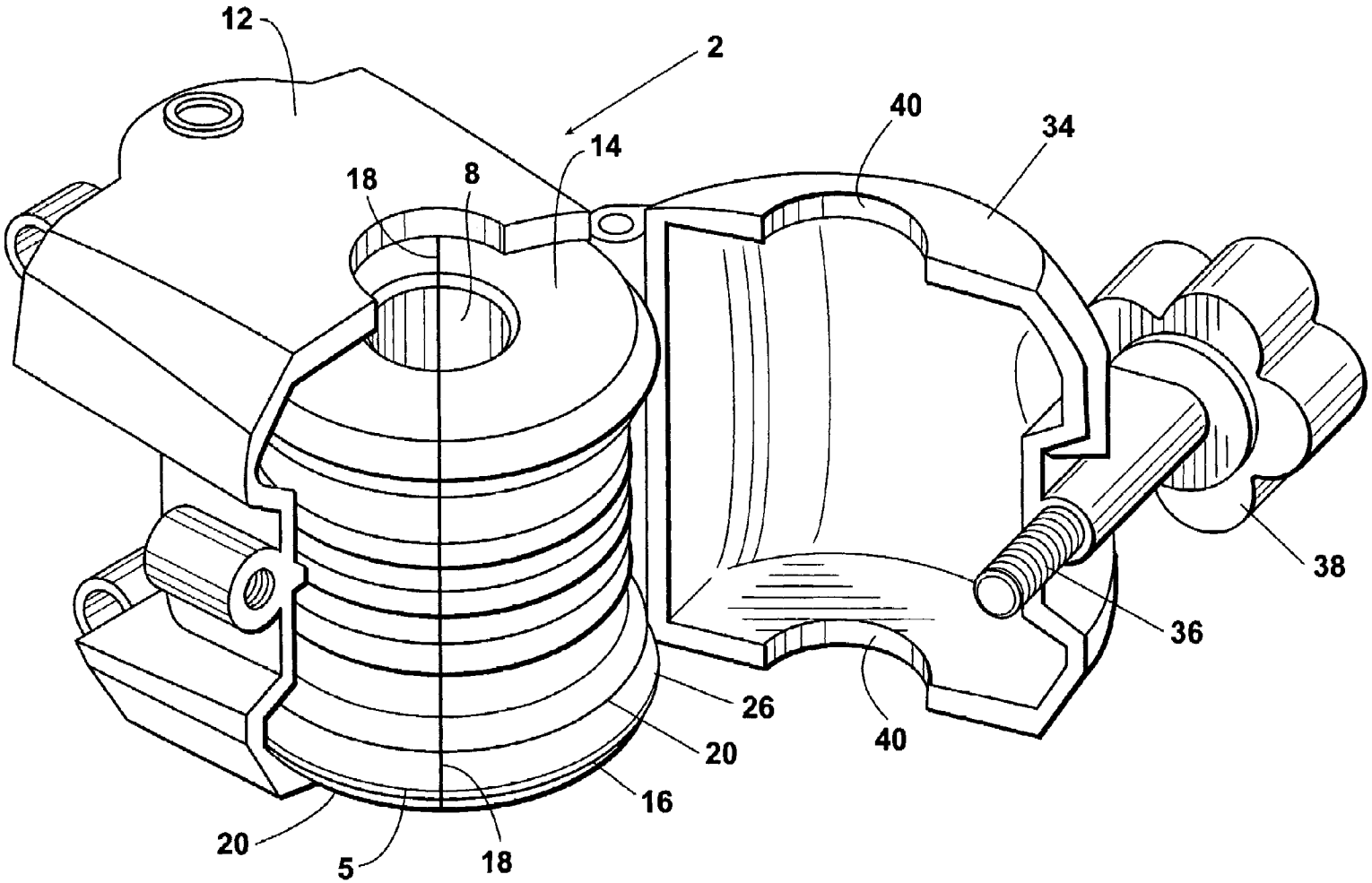
FIG. 1 is a perspective view of an embodiment 2 of the inventive trolling motor mounting assembly which utilizes an embodiment 5 of the inventive gripping isolator sleeve.
Figure 2:
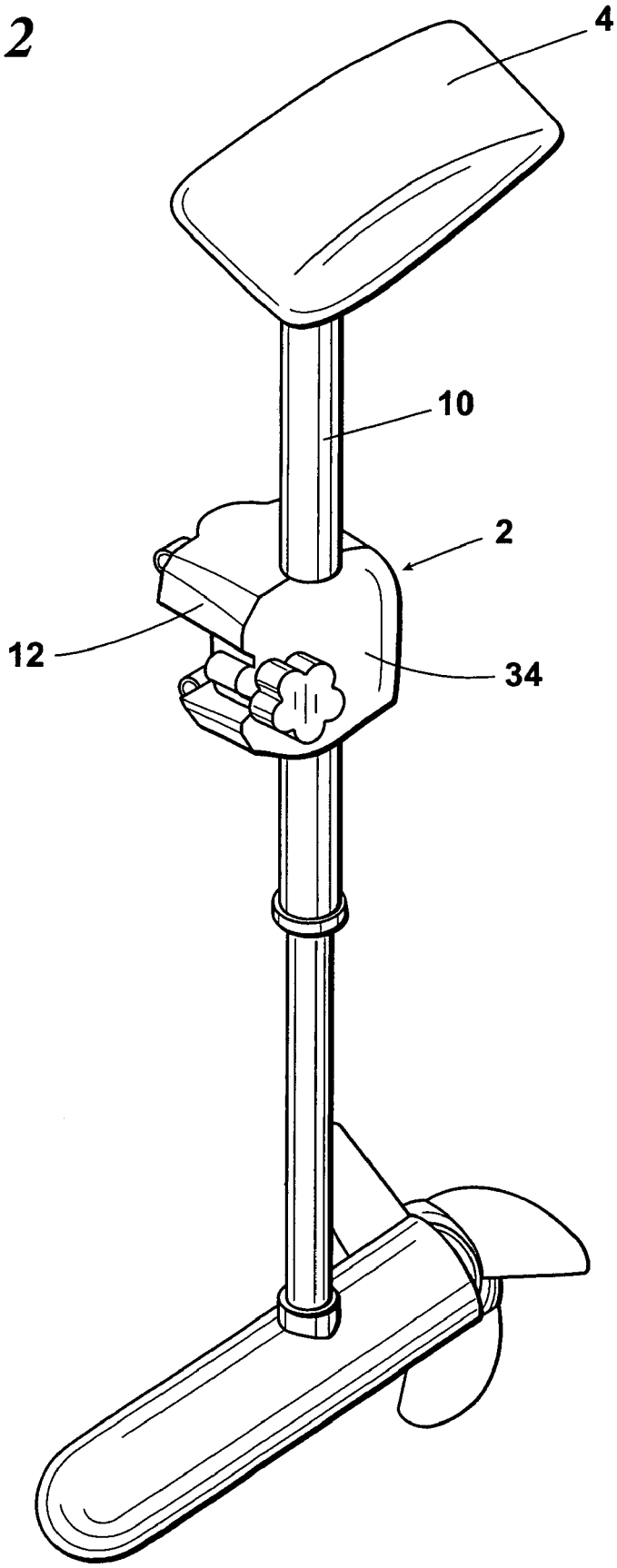
FIG. 2 is a perspective view of the inventive mounting assembly 2 installed on a trolling motor 4.

An embodiment 2 of the inventive mounting assembly is depicted in FIGS. 1-4. The inventive mounting assembly 2 employs an inventive flexible gripping isolator sleeve 5 having a longitudinal bore 8 extending therethrough for receiving and gripping the column 10 of a trolling motor 4. The inventive assembly 2 also comprises a retainer 12 in which the gripping isolator sleeve 5 is received and which retains the gripping isolator sleeve 5 in a manner effective for holding the trolling motor column 10 in its operating position. When placed in the water, the operating position of the trolling motor 4 will typically be substantially vertical. However, the inventive mounting assembly can also be used to mount the trolling motor 4 in any other operating position desired.

The inventive gripping isolator sleeve 5 is formed and configured to be sufficiently flexible within the retainer 12 to allow the trolling motor column 10 to pivot within retainer 12 in the event that an impact occurs between the trolling motor 4 and an underwater obstruction. The gripping isolator sleeve 5 is preferably formed and configured in a manner effective to flex sufficiently to allow the trolling motor column 10 to pivot in any direction up to at least 12°, and more preferably up to at least 21°, from the normal operating position of the motor column 10. In addition, the inventive gripping isolator sleeve 5 is formed and configured in a manner such that it will automatically return to its original shape when the trolling motor 4 is free of the underwater obstruction and will thus act to return the trolling motor column 10 to its operating position. The gripping isolator sleeve 5 will preferably be formed to have sufficient resiliency and/or memory to cause the trolling motor 4 to quickly return to its operating position.

The gripping isolator sleeve 5 also isolates the motor column 10 such that the column 10 does not substantially contact, and most preferably does not contact at all, the retainer 12. Thus, in addition to absorbing impacts, the inventive isolator sleeve 5 also absorbs vibration and significantly reduces or eliminates chattering.

The inventive gripping isolator sleeve 5 can comprise any plastic, natural rubber, synthetic rubber, or other non-metallic material or materials capable of achieving these objectives without rupturing and substantially without any permanent deformation. The inventive gripping isolator sleeve 5 will preferably be formed entirely of one or more such nonmetallic materials. The material(s) used for forming the gripping isolator sleeve 5 will preferably be one or more natural or synthetic rubber materials. The gripping isolator sleeve 5 will most preferably be formed of neoprene. The gripping isolator sleeve 5 will also preferably be produced by injection molding or by extrusion with minimal secondary removal of excess material. Layering of strips and bonding could also be incorporated (with or without high pressure and temperature) in the manufacturing of the sleeve.

If desired, the gripping isolator sleeve 5 can be a unitary structure which does not have any splits therein. The installation of a unitary sleeve will typically require that an end of the motor column to be inserted through the sleeve bore 8.

Figure 10:
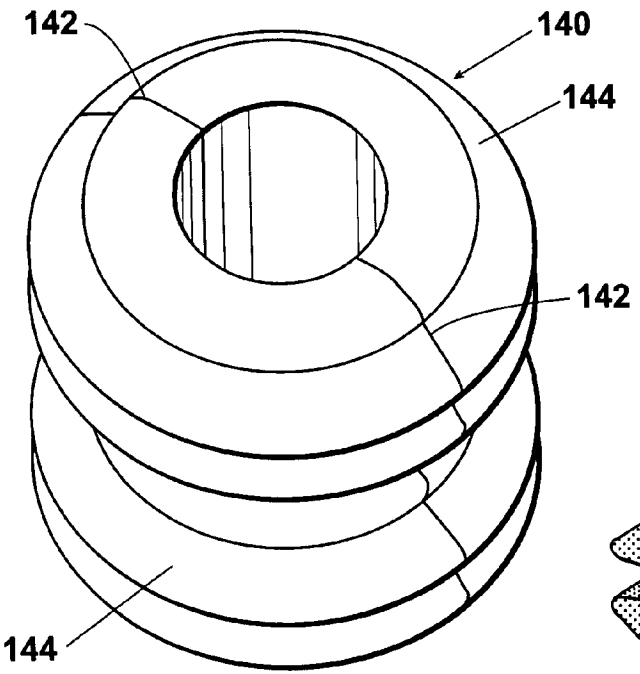
FIG. 10 illustrates an alternative embodiment 140 of the gripping isolator sleeve provided by the present invention.

The gripping isolator sleeve 5 will more preferably be a split isolator sleeve having: a longitudinal upper end 14; a longitudinal lower end 16; and one or more splits 18 in the wall of the isolator sleeve which extend from the upper end 14 to the lower end 16. The gripping isolator sleeve 5 preferably includes a plurality of splits 18 which divide the gripping isolator sleeve 5 into a corresponding number of separable sections 20. As will be apparent, the separated sections 20 of the inventive split isolator sleeve 5 can be quickly and easily positioned together around the motor column 10 without disassembling the trolling motor 4. Although other arrangements can also be used (e.g., the use of spiral splits), each of the splits 18 will preferably be substantially parallel to the longitudinal axis 22 of the isolator sleeve 5. As shown in FIGS. 1 and 10, the inventive isolator sleeve 5, 140 preferably has two splits 18 or 142 which divide the isolator sleeve 5 into two identical sections 20 or 144.

When an inventive split isolator sleeve is used, the individual sections 20 thereof will preferably be sized such that, together, the sections extend over all (100%) or slightly less than the entire circumference of the motor column 10. The individual sections 20 of the split isolator sleeve 5 will preferably extend together over slightly less than the entire circumference of the column 10 so that a greater amount of gripping tension can be created between the inventive isolator sleeve 5 and the motor column 10 when the retainer 12 is tightened around the gripping isolator sleeve 5. The separate sections 20 of the inventive isolator sleeve 5 will preferably be sized such that, before applying any gripping tension to the split isolator sleeve 5, the assembled sections 20, together, will not extend over more than 359° (99%) of the 360° circumference of the column 10. The combined sections 20 will more preferably not extend over more than 350° (97%) of the 360° circumference of the column 10.

To further assist in providing the flexibility, impact absorption, and return characteristics needed for the inventive gripping isolator sleeve 5, the inventive gripping isolator sleeve also preferably includes one or more (preferably a plurality of) voids 24 in the exterior 26 thereof which project into the gripping isolator sleeve 5. The void(s) 24 preferably extend around or substantially around the gripping isolator sleeve 5 such that, except for possible gaps which may be formed by the longitudinal splits 18, the void(s) 24 will completely surround the column 10. The gripping isolator sleeve 5 will preferably include a plurality of voids 24 which are spaced longitudinally apart.

In some embodiments of the inventive gripping isolator sleeve, such as isolator sleeve 5 and some of the other embodiments described below, the gripping isolator sleeve is configured such that the top third portion 28 and the bottom third portion 30 of the gripping isolator sleeve are each individually formed of a greater amount of material than is used to form the middle third portion 32 of the isolator sleeve. In most cases, this will result in an exterior configuration which generally diverges outwardly from the center portion of the isolator sleeve toward each of the upper and lower ends 14 and 16 thereof so that the isolator sleeve has an hourglass shape.

As will also be understood by those in the art, the rubber or other material(s) used for forming the inventive gripping isolator sleeve can be modified or blended, as necessary, for different climates, temperature extremes, or other conditions. In addition, injection molding or other composite molding techniques can be used if desired to form harder and/or more wear resistant layers on any desired contact surfaces. Further, although the separate sections 20 of the inventive split isolator sleeve will preferably be identical in most applications, it will be understood that the individual sections 20 can alternatively be formed of different materials and/or be of different shapes and/or sizes.

The retainer 12 of the inventive mounting assembly 2 can generally be any type of housing or other structure which will receive and retain the gripping isolator sleeve 5 in a manner effective for holding the trolling motor column 10 in its operating position while also permitting the gripping isolator sleeve 5 to flex sufficiently in the event of an impact to allow the trolling motor column 10 to pivot within the retainer 12, preferably in any direction. The retainer 12 will also preferably be readily openable and closeable for conveniently inserting and removing the gripping isolator sleeve 5.

Figure 3:
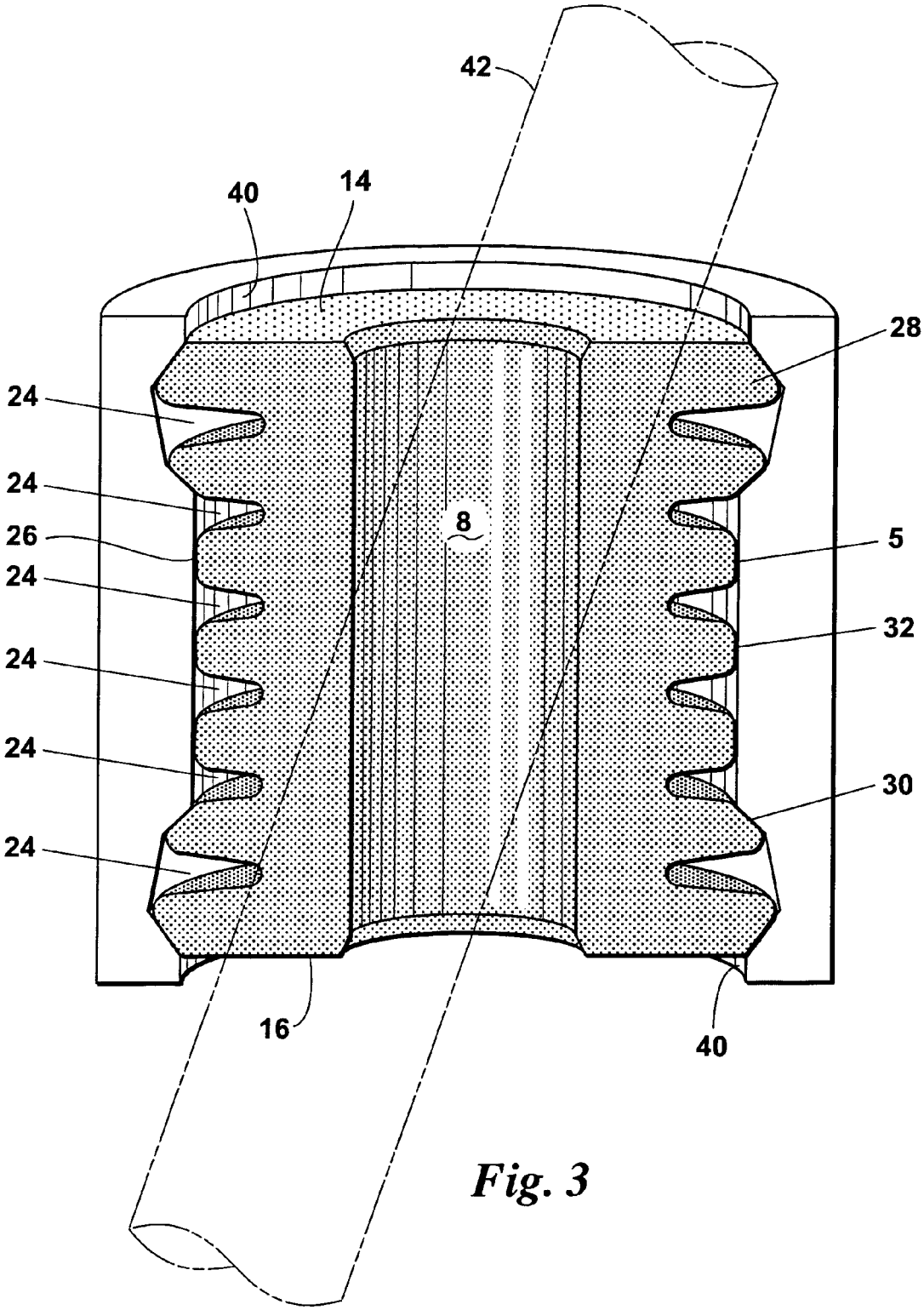
FIG. 3 is a cutaway elevational view of the inventive mounting assembly 2.
Figure 4:
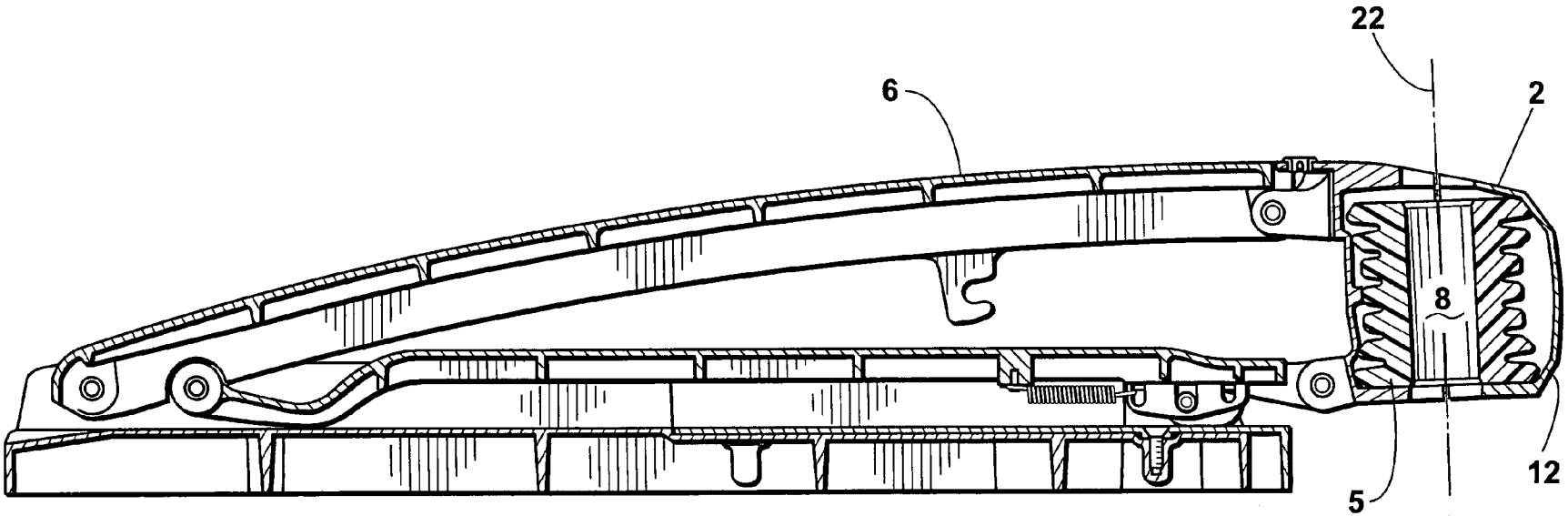
FIG. 4 is an elevational side view of the inventive mounting assembly 2 installed on a GATOR mount (i.e., a four bar linkage device) 6 of a type commonly used in the art for mounting a trolling motor on the deck or hull of a watercraft.

The retainer 12 employed in embodiment 2 of the inventive mounting system shown in FIGS. 1-4 is a gated head having a hinged door 34 which can be opened and closed for conveniently inserting and removing the gripping isolator sleeve 5. As illustrated in FIG. 4 and as also shown in U.S. Pat. No. 6,394,408, gated head structures of the type employed in inventive mounting assembly 2 can be conveniently installed on the end of a GATOR mount or other four bar linkage assembly 6 of the type commonly used for mounting a trolling motor on the deck or hull of a watercraft. A four bar linkage assembly such as GATOR mount 6 can be used to conveniently pivot the trolling motor 4 downwardly into the water in a substantially vertical operating position or upwardly onto the deck or hull of the watercraft in a substantially horizontal stowed position. It will be understood by those in the art, however, that the gated head 12 of the inventive assembly 2 can also be readily adapted for use on a transom mount or on any other type of structure or assembly commonly used for mounting trolling motors.

As illustrated in FIG. 3, the interior of the gated head 12 employed in the inventive mounting assembly 2 is preferably formed to correspond to and contact the exterior 26 of the gripping isolator sleeve 5 along the entire longitudinal length thereof as well as around the entire circumference of the isolator sleeve 5. The gated head 12 also preferably includes a tightenable latch mechanism, such as a tightening bolt 36 and associate hand knob 38, which can be used for securing the hinged door 34 in closed position and for increasing or adjusting the amount of squeezing force applied by the gated head 34 to the gripping isolator sleeve 5. This allows the operator to increase or otherwise adjust the amount of gripping tension between the gripping isolator sleeve 5 and the motor column 10.

The gated head 34 also includes holes 40 in its upper and lower sides through which the motor column 10 will extend. As shown in FIG. 3, the diameter of the holes 40 provided in the gated head 34 will preferably be greater than the diameter of the motor column 10 so that the motor column 10 will be allowed to pivot within the gated head 34 to a pivoted position 42.

In addition to allowing the trolling motor column 10 to deflect as necessary in order to absorb any direct impact from the front, side, or rear, as well as any type of glancing blow, the inventive mounting system 2 will also act to absorb upward blows or impacts to the bottom of the trolling motor 4. In most cases, the nature of the rubber or other material used for forming the gripping isolator sleeve 5 in combination with the void(s) 24 formed around the exterior thereof will allow sufficient vertical compression of the gripping isolator sleeve 5 to absorb an upward blow or impact. The inventive gripping isolator sleeve 5 will then automatically return to its original shape when the trolling motor 4 is clear of the obstruction. In addition, however, in the event of an extreme upward blow or force to the trolling motor 4, the inventive mounting assembly 2 will also allow the motor column 10 to slide upwardly to some degree within the gripping isolator sleeve 5.

Figure 5:
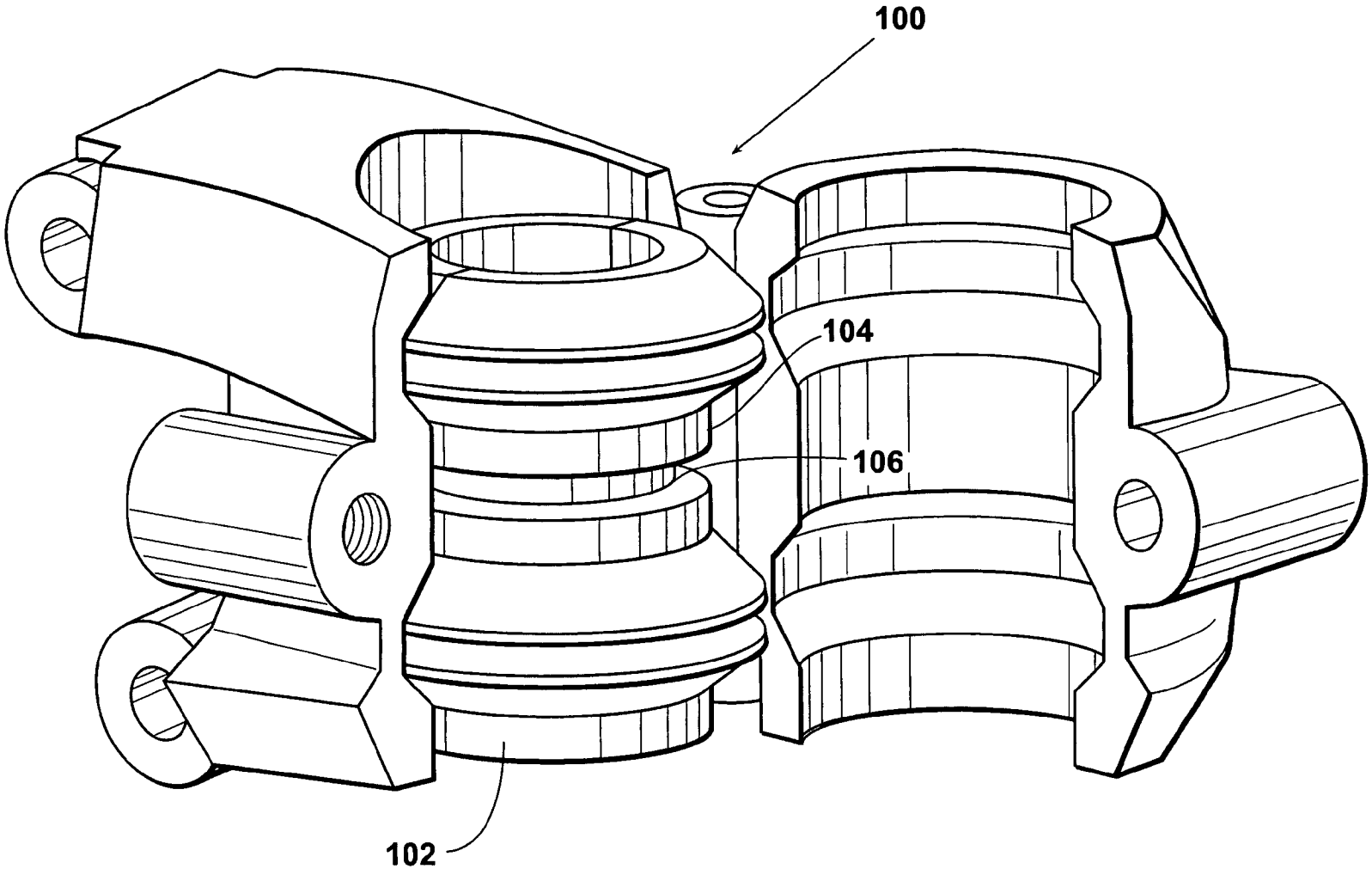
FIG. 5 is a perspective view of an embodiment 100 of the inventive trolling motor mounting assembly which utilizes an embodiment 102 of the inventive gripping isolator sleeve.
Figure 6:
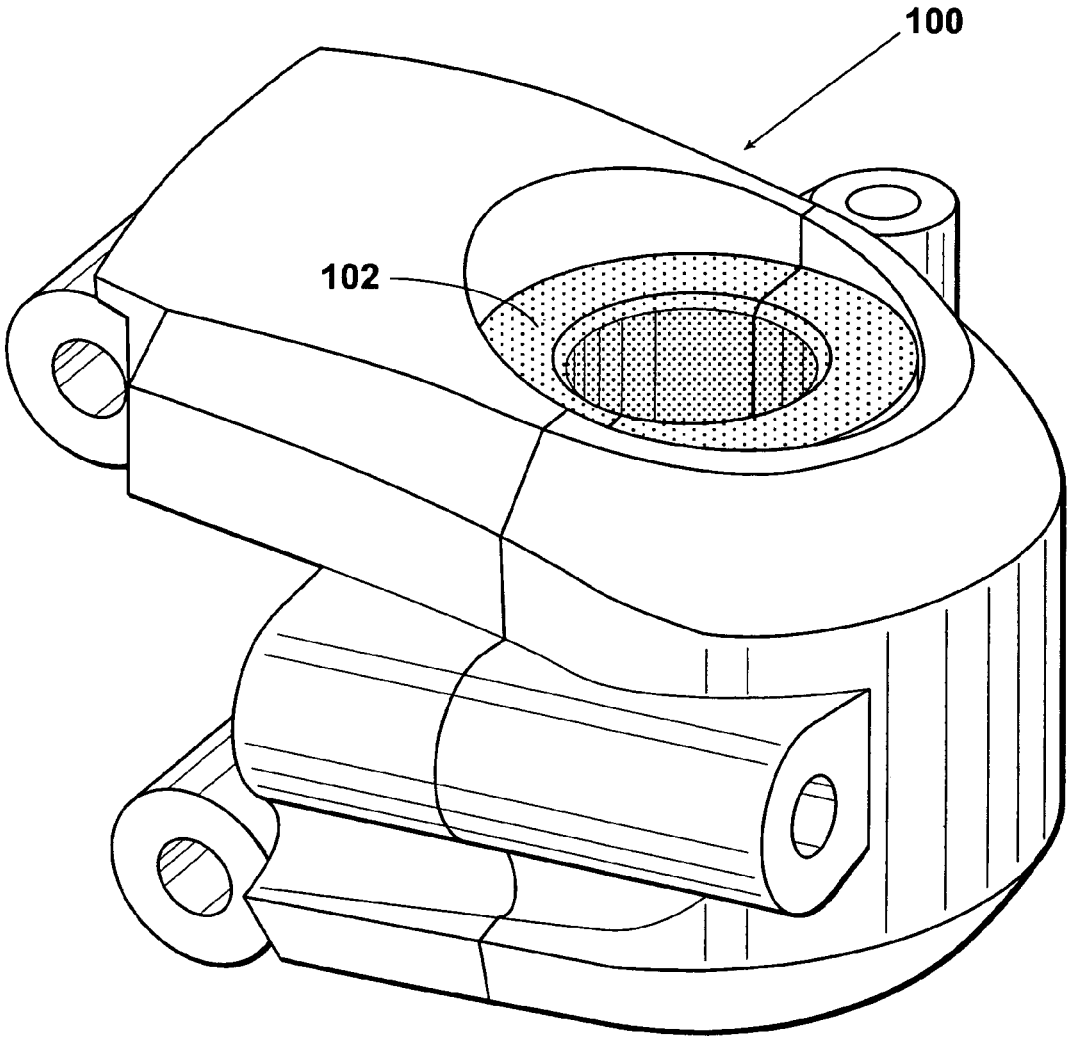
FIG. 6 is a perspective view of the inventive mounting system 100 in closed position.

An alternative embodiment 100 of the inventive impact absorbing mounting assembly is depicted in FIGS. 5 and 6. The inventive system 100 is constructed and operates in essentially the same manner as inventive assembly 2 except that the inventive assembly 100 uses a gripping isolator sleeve 102 which has a slightly different configuration. The inventive gripping isolator sleeve 102 operates in the same manner as inventive isolator sleeve 5 and, as with isolator sleeve 5, is formed using a greater amount of material in each of the upper and lower one-third portions thereof than is used in the middle third portion. However, the exterior of inventive isolator sleeve 102 includes a wide middle void 104 having an additional deep groove 106 around the center thereof which give the inventive gripping isolator sleeve 102 an even more pronounced hourglass shape.

Figure 7:
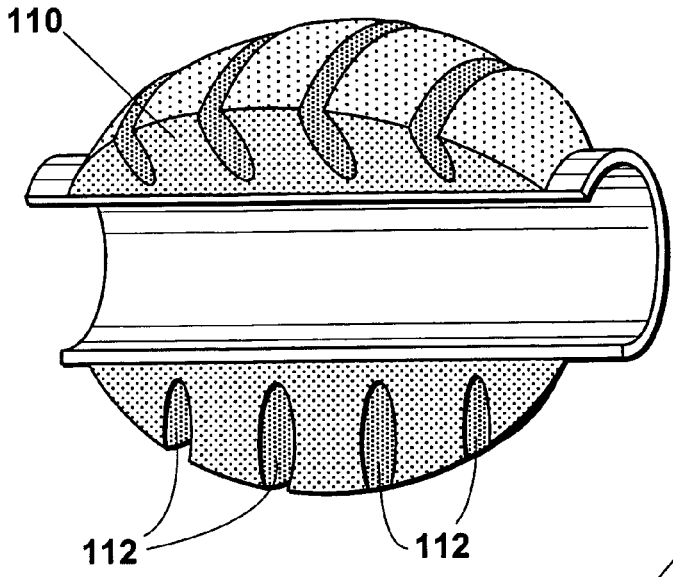
FIG. 7 illustrates an alternative embodiment 110 of the gripping isolator sleeve provided by the present invention.
Figure 8:
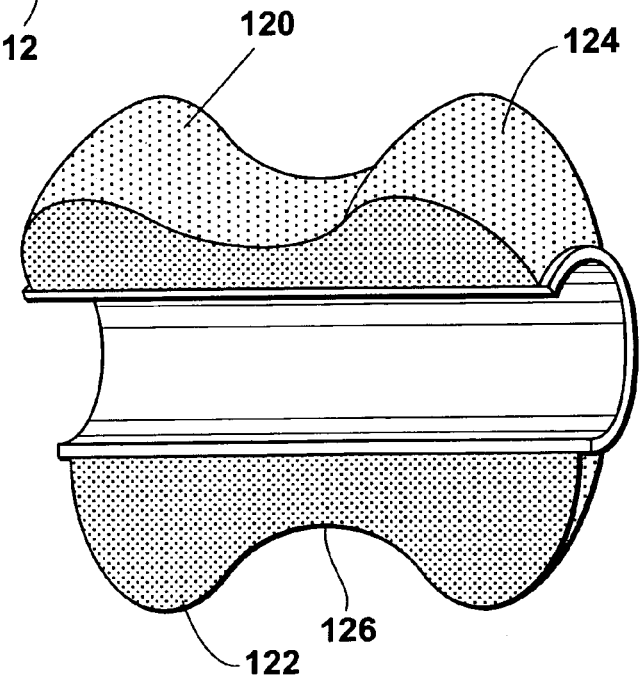
FIG. 8 illustrates an alternative embodiment 120 of the gripping isolator sleeve provided by the present invention.
Figure 9:
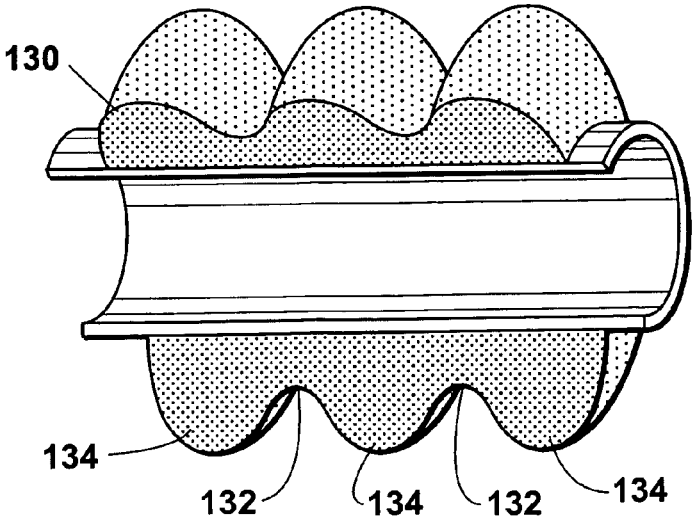
FIG. 9 illustrates an alternative embodiment 130 of the gripping isolator sleeve provided by the present invention.

Examples of other alternative configurations of the inventive gripping isolator sleeve which can be used in the inventive mounting assembly are illustrated in FIGS. 7-9. FIG. 7 depicts a rounded gripping isolator sleeve 110 having a series of longitudinally spaced, spear-shaped voids 112 formed around the exterior thereof. FIG. 8 depicts another hourglass-shaped embodiment 120 of the inventive gripping isolator sleeve having very rounded end portions 122 and 124 and a single wide, U-shaped void 126 formed around its mid-portion. FIG. 9 depicts an embodiment 130 of the inventive gripping isolator sleeve having alternating rounded voids 132 and rounded projections 134 which form a uniform wave pattern.

Figure 12:
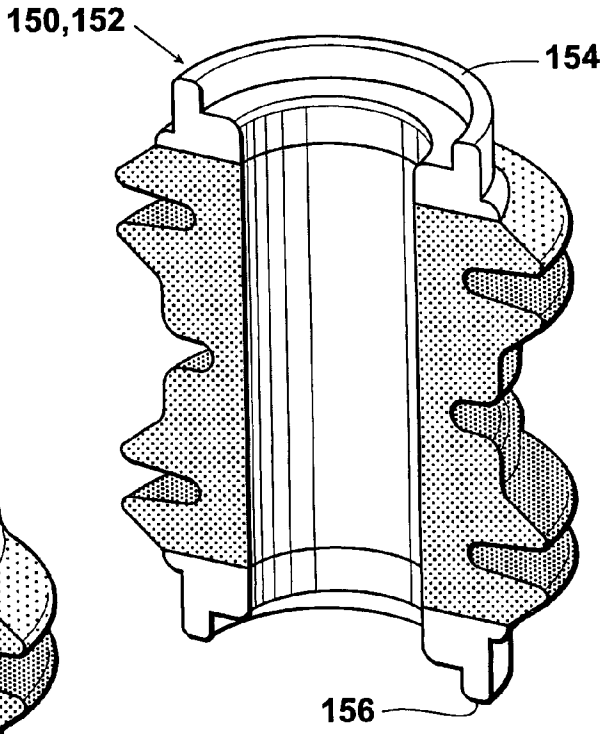
FIG. 12 is a perspective view of a separable section 152 of an embodiment 150 of the inventive gripping isolator sleeve.
Figure 11:
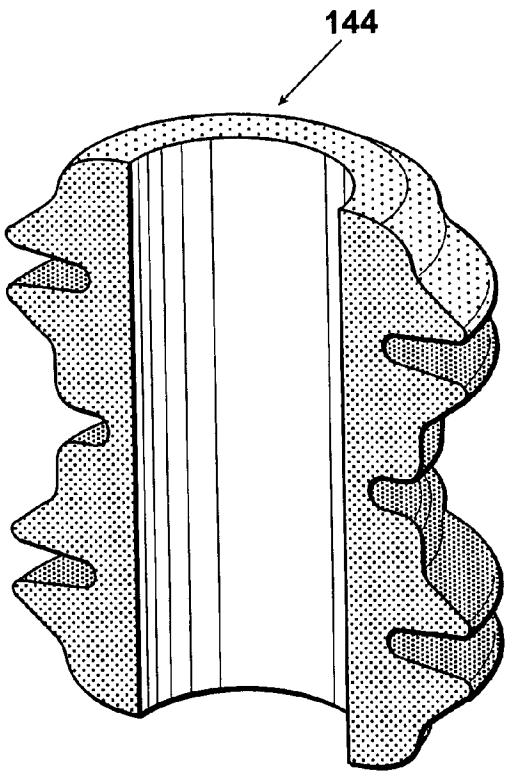
FIG. 11 is a perspective view of a separable section 144 of the inventive isolator sleeve 140.

FIG. 10 shows an embodiment 140 of the inventive gripping isolator sleeve which is very similar to sleeve 102 except that sleeve 140 is a split isolator sleeve having two longitudinal splits 142 therein which separate the split sleeve 140 into two identical sections 144. FIG. 11 provides an interior view of one of these sections 144. FIG. 12 shows one section 152 of another embodiment 150 of the inventive split isolator sleeve. The inventive split sleeve 150 is substantially identical to inventive split sleeve 140 except that inventive sleeve 150 includes flexible ring sections 154 and 156 which project longitudinally from the ends of sleeve 150.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. An assembly for grasping a column of a trolling motor to mount said trolling motor on a watercraft comprising:

a flexible gripping isolator sleeve positioned on said column and a retainer in which said gripping isolator sleeve is received so that said gripping isolator sleeve will hold said column in an operating position, said retainer having openings through which said column extends so that said retainer does not contact said column and so that, except for said gripping isolator sleeve, no other mounting element for assisting in retaining said column in said operating position is in contact with said column, said retainer having a hinged door which is pivotably openable for receiving and removing said gripping isolator sleeve and said retainer also including a tightenable latch for said hinged door, said gripping isolator sleeve imparting a sufficient degree of gripping tension to said column so that said gripping isolator sleeve holds said column securely in said operating position during normal operating conditions when said watercraft is traveling on a body of water and a lower end of said trolling motor extends beneath a surface of said body of water, said gripping isolator sleeve having an exterior, said gripping isolator sleeve having a configuration including at least one outer void in said exterior which projects into and extends substantially around said gripping isolator sleeve and which remains empty when said gripping isolator sleeve is held by said retainer so that, to protect said trolling motor from being damaged when an impact occurs between said lower end of said trolling motor and an underwater obstruction, said gripping isolator sleeve will flex sufficiently within said retainer that said column will pivot in any direction about a point within, and with respect to, said retainer up to at least 12° away from said operating position, and wherein said gripping isolator sleeve comprises at least one nonmetallic material which will automatically act to immediately return said column to said operating position within said retainer when said trolling motor is free of said underwater obstruction.

2. The assembly of claim 1 wherein said gripping isolator sleeve is removably positionable on said column when said trolling motor is assembled, without any disassembly of said trolling motor being required.

3. The assembly of claim 1 wherein said gripping isolator sleeve is a split isolator sleeve having a first longitudinal end, a second longitudinal end, and at least one split in said gripping isolator sleeve extending from said first longitudinal end to said second longitudinal end.

4. The assembly of claim 3 wherein said gripping isolator sleeve has a plurality of splits therein extending from said first longitudinal end to said second longitudinal end such that said splits divide said gripping isolator sleeve into a plurality of separable sections which can be placed on said column.

5. The assembly of claim 4 wherein said gripping isolator sleeve has a longitudinal axis and wherein said splits are substantially parallel to said longitudinal axis.

6. The assembly of claim 4 wherein said gripping isolator sleeve includes only two of said sections and wherein said two sections are identical to each other.

7. The assembly of claim 1 wherein said retainer is a gated head and said tightenable latch comprises a tightening bolt having a hand knob thereon.

8. The assembly of claim 1 wherein said configuration of said gripping isolator sleeve includes a plurality of outer voids in said exterior which are spaced apart longitudinally and wherein said outer voids project into and extend substantially around said gripping isolator sleeve and said outer voids will remain empty when said gripping isolator sleeve is held by said retainer.

9. The assembly of claim 1 wherein said gripping isolator sleeve has been formed by molding.

10. The assembly of claim 1 wherein said nonmetallic material is neoprene.

11. The assembly of claim 1 wherein said gripping isolator sleeve will flex sufficiently within said retainer when said impact occurs that said column will pivot about said point within, and with respect to, said retainer up to at least 21° from said operating position in any direction.

12. The assembly of claim 1 further comprising a four bar linkage mount which holds said retainer, said four bar linkage mount being mountable on said watercraft.

13. The assembly of claim 12 wherein said four bar linkage mount is a GATOR mount.

* * * * *